US009486062B1

(12) United States Patent
Piatetsky

(10) Patent No.: US 9,486,062 B1
(45) Date of Patent: Nov. 8, 2016

(54) BRISTLE FOR LIQUID-DISPENSING HAIRBRUSH

(71) Applicant: Andrey Piatetsky, Tarzana, CA (US)

(72) Inventor: Andrey Piatetsky, Tarzana, CA (US)

( * ) Notice: Subject to any disclaimer, the term of this patent is extended or adjusted under 35 U.S.C. 154(b) by 0 days.

(21) Appl. No.: 14/841,655

(22) Filed: Aug. 31, 2015

(51) Int. Cl.
*A45D 24/22* (2006.01)
*A46B 11/00* (2006.01)

(52) U.S. Cl.
CPC ..... *A46B 11/0013* (2013.01)

(58) Field of Classification Search
CPC ..... A45D 24/22; A45D 24/46; A46B 11/00; A46B 11/0006; A46B 11/0013; A46B 11/041
See application file for complete search history.

(56) References Cited

U.S. PATENT DOCUMENTS 2,519,740 A * 8/1950 Call ..... A45D 24/24 132/115
3,101,086 A 8/1963 Di Vito
4,055,195 A 10/1977 Moses
5,927,290 A 7/1999 Thiruppathi
6,158,442 A 12/2000 Piatetsky
6,341,914 B2 1/2002 Abe et al.
6,530,378 B1 * 3/2003 Piatetsky ..... A46B 11/0062 132/115
7,083,352 B2 8/2006 Ando et al.
7,862,249 B2 1/2011 Ohashi et al.
2015/0026904 A1 * 1/2015 Piatetsky ..... A45D 24/22 15/207.2

* cited by examiner

*Primary Examiner* — Rachel Steitz

(57) ABSTRACT

A bristle of a liquid-dispensing hairbrush designed to deliver low-viscosity liquids to a user's scalp during hair-brushing only by gravity and not capillary action. The bristle has a tube with an internal channel with a maximum diameter M and a length L. There is a roller-ball nozzle having a ball with diameter B and a ball seat into which the ball movable fits. The ball seat has radially spaced apart inwardly directed protrusion portions with protrusion portion spaces therebetween. The protrusion portions have apexes, wherein a central hole is defined by an imaginary circle which contacts the apexes of the protrusion portions, and the central hole has a diameter, and the ball seat has a minimum cross-sectional area S which is free for liquid flow. The protrusion portion spaces are large enough so that liquid can flow through the protrusion portion spaces and through the central hole only by gravity, and not by capillary action. A ratio of $8<L/\sqrt{S}<25$ is satisfied. A ratio of $L/M>8$ is satisfied. Furthermore, the ratio of $M/B<1.3$ is satisfied.

14 Claims, 9 Drawing Sheets

BRISTLE FOR LIQUID-DISPENSING HAIRBRUSH

FIELD OF THE INVENTION

The invention relates to hairbrushes and more particularly to a bristle of a liquid-dispensing hairbrush designed to deliver low viscosity liquids to a user's scalp during hair-brushing only by gravity and not by capillary action.

BACKGROUND OF THE INVENTION

Liquid-reservoir hairbrushes and combs have been available for years. In addition to combing and brushing, these devices allow a user to distribute water and oil-based liquids over the user's scalp and/or through the user's hair. In some of these devices, liquid nozzles are located at the body of the hair device or at the base of the bristles, so the liquid disperses from the nozzles initially distributed over and though the hair and only then can disperse over the user's scalp. In other devices specifically designed to disperse the liquid over the user's scalp, the nozzles are located at the distal ends of the comb teeth or hairbrush bristles. Thus, the liquid in these devices is initially distributed over the scalp and does not wet the hair.

If the nozzles are located at the bristle's ends and designed to disperse the liquid over a user's scalp, the bristle design should allow the user to manually control the amount of the liquid which disperses from the bristles during hair-brushing. Whereas pumps were used in some devices to force and control the liquid flow dispensed from the nozzles, in some other prior art devices roller-ball nozzles with absorbent feed rods that depend on capillary action were used.

Initially invented for roller-ball pens, roller-ball nozzles with absorbent feeders relied on capillary action to prevent a natural outflow of the low-viscosity liquid from the roller-ball nozzle. However, since compared to a pen, the hairbrush bristle needs to disperse a much greater volume of liquid, prior art bristles with capillary action nozzles have great difficulty in dispersing a sufficient amount of liquid over the users' scalp during hair-brushing. There are also numerous ball point and roller-ball pen tips, including gel roller-ball pen tips, but all of these either use a high viscosity oil based ink and/or capillary action to disperse the ink from the roller-ball nozzle.

Furthermore, air needs to enter the brush liquid reservoir from outside to equalize the air pressure so that liquid can be dispersed from the roller-ball nozzle. Thus, it is important that liquid-dispensing hairbrush bristles have the capacity for air to move from outside the liquid reservoir into the liquid reservoir as liquid leaves the reservoir, and at the same time have the ability to dispense a sufficient amount of the liquid over the user's scalp during hair-brushing.

However, neither current designs of liquid-dispensing bristles nor ball point and roller-ball pen tips have this capability. Thus, prior art bristles fail to achieve acceptable results for dispersing low viscosity liquids over the user's scalp during hair-brushing.

SUMMARY OF THE INVENTION

The present invention is a bristle of a liquid-dispensing hairbrush designed to deliver liquids to a user's scalp during hair-brushing only by gravity, and not by capillary action, comprising: a tube with a tube wall and an outer surface, and with an internal channel, wherein the internal channel has a maximum diameter and a length; and a roller-ball nozzle, wherein the roller-ball nozzle has a ball with a ball diameter, and a ball seat into which the ball movable fits, and wherein the ball seat has a plurality of radially spaced apart inwardly directed protrusion portions with protrusion portion spaces therebetween, and wherein the protrusion portions have apexes, wherein a central hole is defined by an imaginary circle which contacts the apexes of the protrusion portions, and wherein the central hole has a diameter, and wherein the ball seat has a minimum cross-sectional area which is free for liquid flow; and wherein the protrusion portion spaces are large enough so that liquid can flow through the protrusion portion spaces and through the central hole only by gravity, and not by capillary action; and wherein a ratio of $8<L/\sqrt{S}<25$ is satisfied, where L is the length of the internal channel and S is a minimum cross-sectional area of the ball seat which is free for liquid flow; and wherein the ratio of $L/M>8$ is satisfied, where L is the length of the internal channel and M is the maximum diameter of the internal channel; and wherein the ratio of $M/B<1.3$ is satisfied, where M is the maximum diameter of the internal channel and B is the diameter of the ball.

These and other features of the invention are described below.

DETAILED DESCRIPTION

Figure 1:
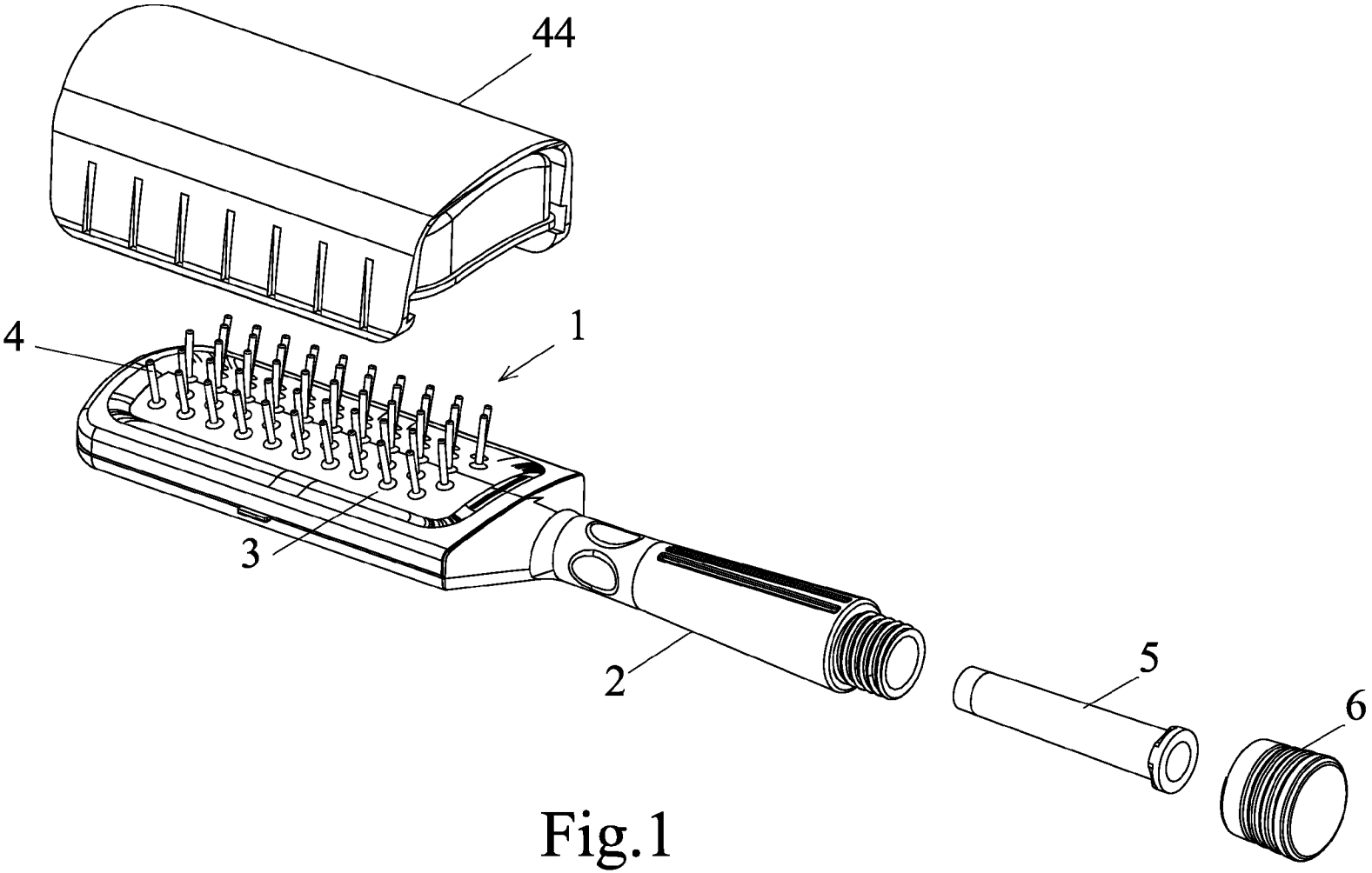
FIG. 1 is an isometric view of a liquid-dispensing hairbrush with a removable cover. The liquid dispensing bristles of the invention are shown mounted to a flexible membrane of the liquid-dispending hairbrush.

Referring to FIG. 1, a liquid-dispensing hairbrush 1 of the present invention has a handle 2 and a flexible membrane 3 with a plurality of bristles 4. The handle 2 has a filler inlet 5 and a cap 6, so the user can unscrew the cap 6 and then remove filler inlet 5 to fill the hairbrush 1 with liquid through the handle 2. The hairbrush 1 has a removable cover 44 to prevent evaporation of liquid from the hairbrush 1 when the hairbrush 1 is not in use.

Referring to FIGS. 2, 3, 4A, 4B, 4C and 5 of the first embodiment of the invention, each bristle 4 is comprised of a tube 7, a roller-ball nozzle 8 and a holder 9. The tube 7 has a proximal end 10 and a distal end 11. The proximal end 10 is connected to the flexible membrane 3 by the holder 9. The liquid 12 is retained inside the brush 1 in a liquid reservoir 13. The holder 9 has a bottom part 15 and a top part 16 which are connected by press-fitting without using glue. The proximal end 10 of the tube 7 is inserted into the bottom part 15 of the holder 9 by press-fitting without using glue.

The bristle 4 has a roller-ball nozzle 8 (FIG. 3) which is formed by inserting a roller-ball tip 14 into the distal end 11 of the tube 7. The tube 7 has a tube wall 19 with an outer surface 20, and with an internal channel 17 which is free for liquid flow. The internal channel 17 has a maximum diameter M1, a holder edge 21 and a length L1. The roller-ball nozzle 8 (FIGS. 3, 4A, 4B, 4C and 5) has a ball 18 with a ball diameter B, and a ball seat 22 into which the ball 18 movable fits. The ball seat 22 has a plurality of radially spaced apart inwardly directed protrusion portions 23 with protrusion portion spaces 24 therebetween and a ball space 45. The protrusion portions 23 have apexes 25 and a top edge 28, wherein a central hole 26 is defined by an imaginary circle 27 which contacts the apexes 25 of the protrusion portions 23, and wherein the central hole 26 has a diameter H1, and wherein the ball seat has a minimum cross-sectional area S1 (FIG. 5) which is free for liquid flow. The length L1 (FIG. 2) of the internal channel 17 of the tube 7 is defined as a shortest distance between the holder edge 21 of the internal channel 17 and the top edge 28 of the protrusion portions 23. The diameter B of the ball 18 is about 1.6 mm, but depending on the length L1 and the maximum internal diameter M1 of the internal channel 17, the diameter B of the ball 18 ranges in size between 1.2 mm and 2.0 mm.

Figure 8B:
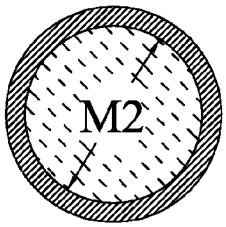
FIG. 8B is a radial cross-section view through section lines 8B-8B of FIG. 8A.
Figure 8A:
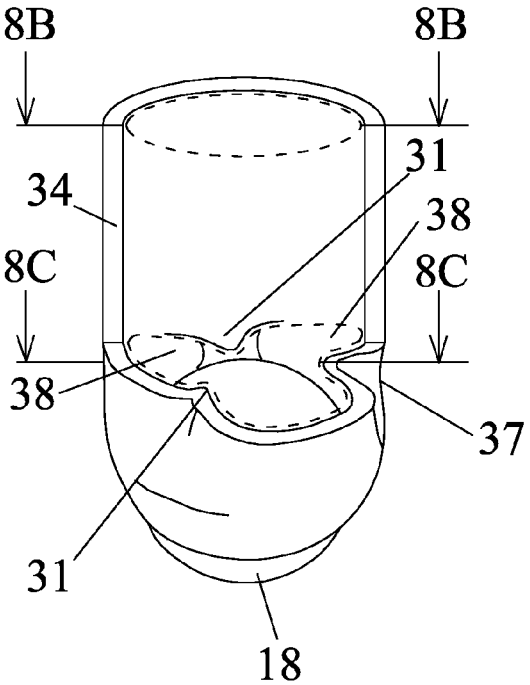
FIG. 8A is another isometric detail view of the distal end of the liquid-dispensing bristle of FIG. 6.
Figure 8C:
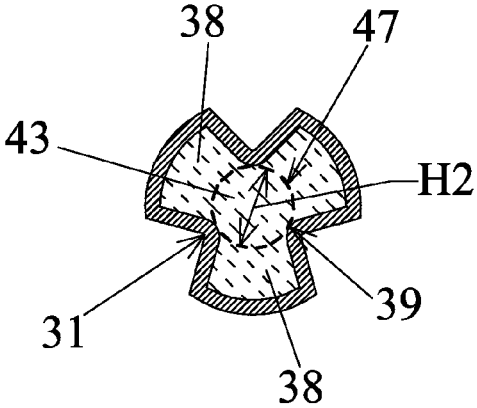
FIG. 8C is a radial cross-section view through section lines 8C-8C of FIG. 8A.

Referring to FIGS. 6, 7, 8A, 8B. 8C and 9 of a second embodiment of the invention, a bristle 29 has a roller-ball nozzle 30 where protrusion portions 31 are formed by pressing to an outer surface 32 of a distal end 41 of a tube 33 in at least three points so that a tube wall 34 extends inwardly. A proximal end 42 of the tube 33 is inserted into the bottom part 15 of the holder 9 and has a holder edge 40. The bottom part 15 and the top part 16 of the holder 9 are connected by press-fitting without using glue. The proximal end 42 of the tube 33 is inserted into the bottom part 15 of the holder 9 by press-fitting without using glue. The bristle 29 has an internal channel 35 which is free for liquid flow. The internal channel 35 has a maximum diameter M2 and a length L2. The roller-ball nozzle 30 has the ball 18 with a ball diameter B, and a ball seat 37 into which the ball 18 movable fits. The ball seat 37 has three inwardly directed protrusion portions 31 with protrusion portion spaces 38 therebetween and a ball space 46. The protrusion portions 31 have apexes 39 and a top edge 36, wherein a central hole 43 is defined by an imaginary circle 47 (FIGS. 8C and 9) which contacts the apexes 39 of the protrusion portions 31, and wherein the central hole 43 has a diameter H2, and wherein the ball seat 37 has a minimum cross-sectional area S2 (FIG. 9) which is free for liquid flow. The length L2 (FIG. 6) of the internal channel 35 of the tube 33 is defined as a shortest distance between the holder edge 40 of the internal channel 35 and the top edge 36 of the protrusion portions 31.

Referring to FIGS. 2, 3, 4A, 4B. 4C and 5 of the first embodiment of the invention, the maximum internal diameter M1 of the internal channel 17 is about 1.6 mm and the length L1 of the internal channel 17 is about 18 mm. The diameter H1 of the central hole 26 is about 0.82 mm and a minimum cross-sectional area S1 which is free for liquid flow is about 1.13 $mm^2$.

Referring to FIGS. 6, 7, 8A, 8B. 8C and 9 of the second embodiment of the invention, the maximum internal diameter M2 of the internal channel 35 of the tube 33 is about 1.6 mm and the length L2 of the internal channel 35 is about 18 mm. The diameter H2 of the central hole 43 is about 0.71 mm and has a minimum cross-sectional area S2 which is free for liquid flow is about 1.53 $mm^2$. The diameter B of the ball 18 is about 1.6 mm, but depending on the length L2 and the maximum internal diameter M2 of the internal channel 35, the diameter B of the ball 18 ranges in size between 1.2 mm and 2.0 mm.

Referring to FIGS. 2-9 of the invention, the tubes 7 and 33 and the balls 18 can preferably be made from stainless-steel, but it also can be made from a plastic or any other known materials. The bottom part 15 of the holder 9 can preferably be made from nylon and the top part 16 can preferably be made from polypropylene. The roller-ball tip 14 can preferably be made from stainless steel and the flexible membrane 3 can preferably be made from a silicone. However, other materials can be selected for use in constructing the bottom part 15, the top part 16, the roller ball-tip 14, and the flexible membrane 3. The diameter B of the ball 18 is typically about 1.6 mm, but depending on the length of the bristle tubes and maximum interior diameter of the tube, the ball 18 diameter ranges in size between 1.2 mm and 2.0 mm.

Referring to the first and second embodiments of the invention (FIGS. 2-9), when the bristles are positioned downwardly during hair-brushing, the liquid 12 located inside the liquid reservoir 13 flows in the direction from the liquid reservoir 13 to the roller-ball nozzle 8 and 30 through the internal channels 17 and 35 only by gravity, and not by capillary action. The ball 18 movable mounted within the ball seats 22 and 37 and can move within the ball space 45 and 46 when the ball 8 contacts the user's scalp during hair-brushing. The protrusion portion spaces 24 and 38, and the ball spaces 45 and 46 are large enough so that liquid 12 can flow through the protrusion portion spaces 24 and 38 and through the central holes 26 and 43 and then through the ball spaces 45 and 46 only by gravity, and not by capillary action. The liquid 12 exits the roller-ball nozzles 8 and 30 and disperses over the user's scalp when the ball 18 contacts the user's scalp during hair-brushing. The ball spaces 45 and 46 are large enough, so that the ball 18 can move during hair-brushing within the ball seats 22 and 37 by gravity force even when the ball 18 doesn't contact the user's skin. The liquid 12 located into the internal channels 17 and 35 can move during hair-brushing depending on position of the bristles 4 and 29 relative to the direction of gravity force in two different directions: in the direction from the liquid reservoir 13 to the roller-ball nozzles 8 and 30, or in the direction from the roller-ball nozzles 8 and 30 to the liquid reservoir 13. When the liquid 12 located in the internal channels 17 and 35 moves by gravity force in the direction from the roller-ball nozzles 8 and 30 to the liquid reservoir 13, the ball 18 also can move within the ball spaces 45 and 46, so air located outside of the roller-ball nozzles 8 and 30 can come into the rollerball nozzle 8 and 30 and then flow through the internal channels 17 and 35 and enter the liquid reservoir 13. This air flow will equalize the air pressure in the liquid reservoir 13 to atmospheric pressure to allow the liquid 12 to exit from other roller-ball nozzles 8 and 30 which contact the user's scalp during hair-brushing.

Figure 2:
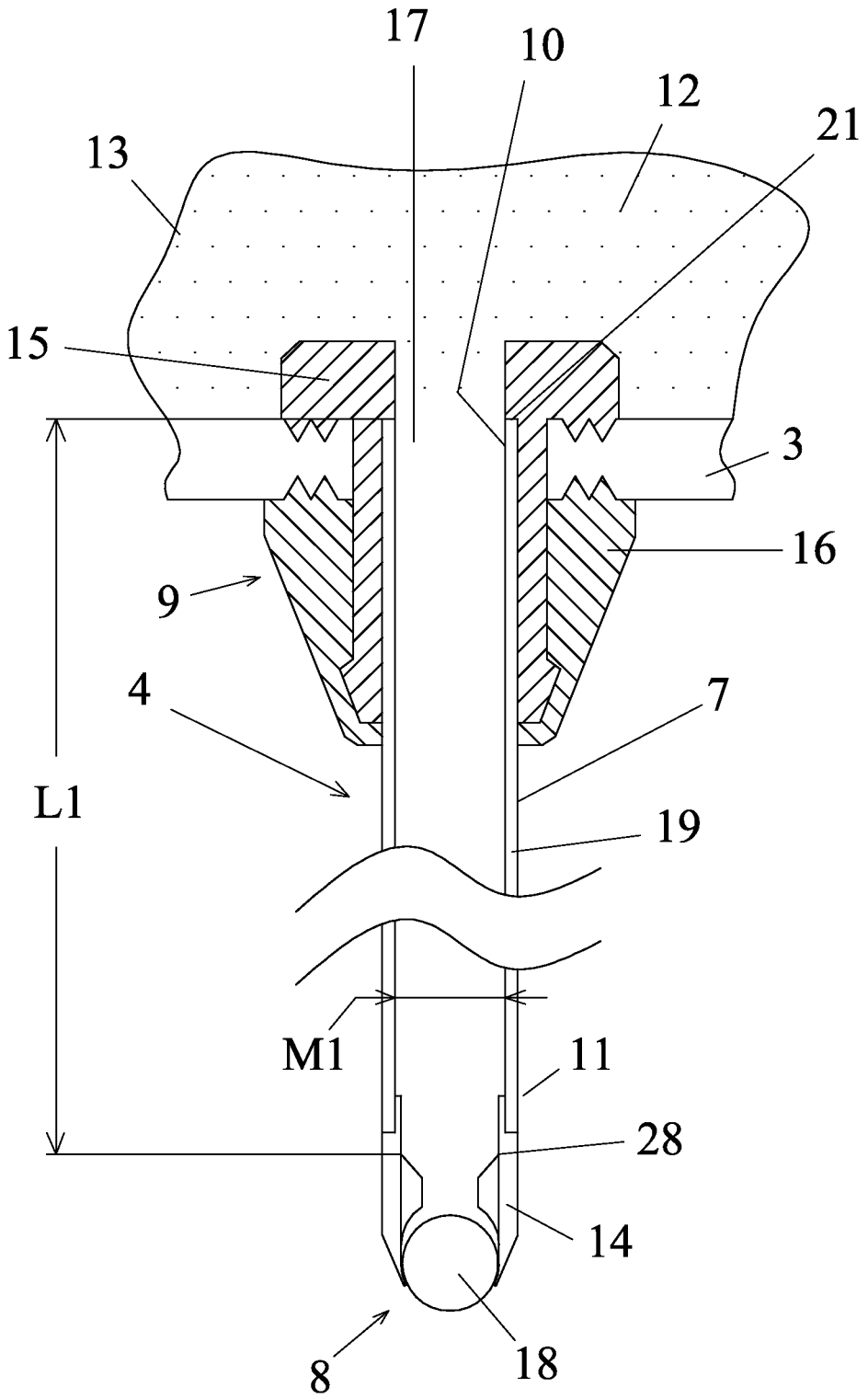
FIG. 2 is a longitudinal cross-section view of a first exemplary embodiment of a liquid-dispensing bristle of the invention mounted to a flexible membrane of a liquid-dispending hairbrush.
Figure 3:
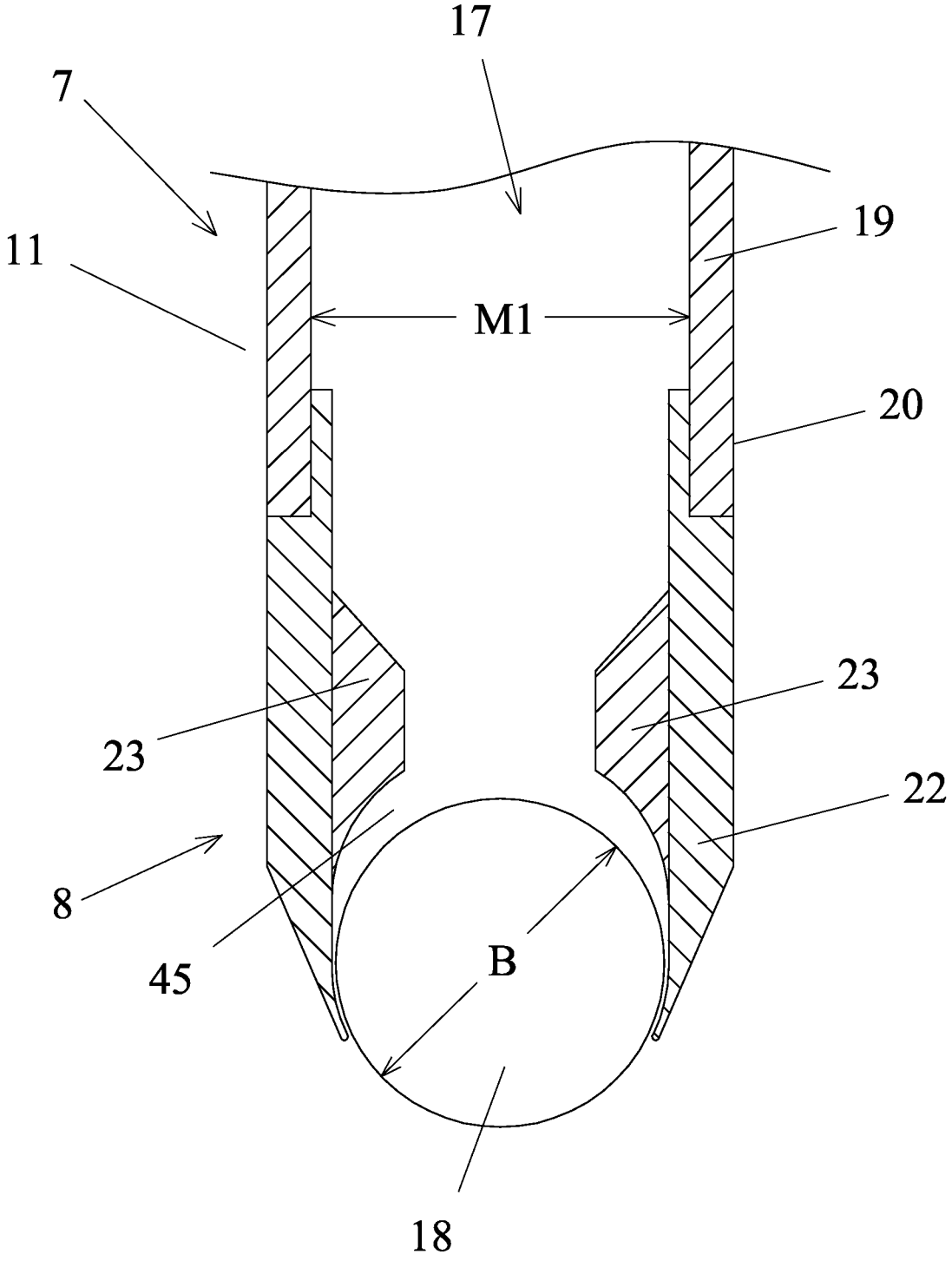
FIG. 3 is longitudinal cross-sectional detail view of a distal end of the liquid dispensing-bristle of FIG. 2.
Figure 4A:
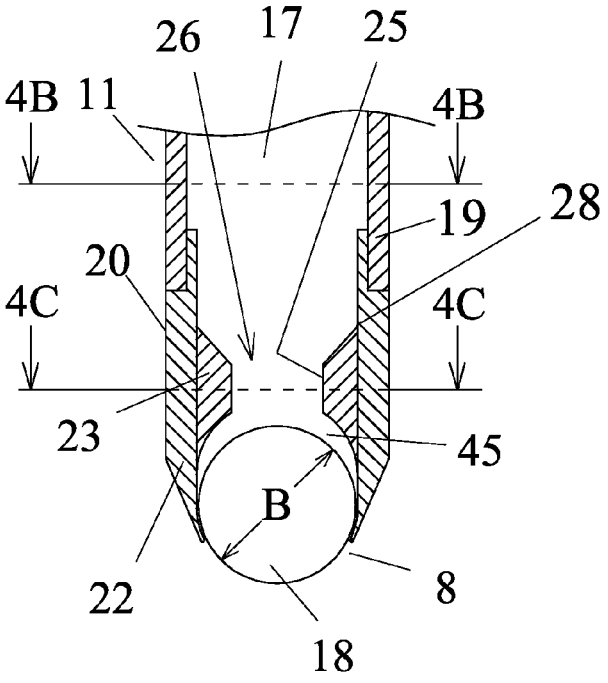
FIG. 4A is a further longitudinal cross-sectional detail view of the distal end of the liquid-dispensing bristle of FIG. 2.
Figure 4B:
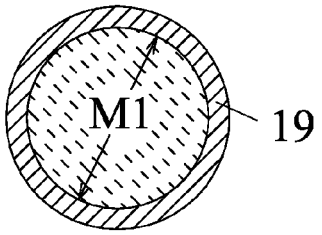
FIG. 4B is a radial cross-section view through section lines 4B-4B of FIG. 4A.
Figure 4C:
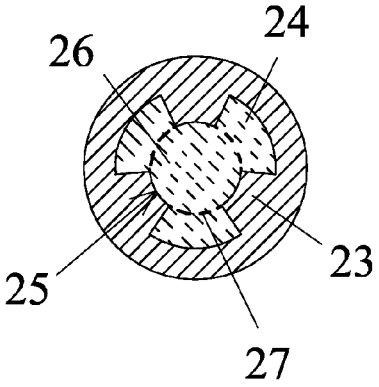
FIG. 4C is a radial cross-section view through section lines 4C-4C of FIG. 4A.
Figure 5:
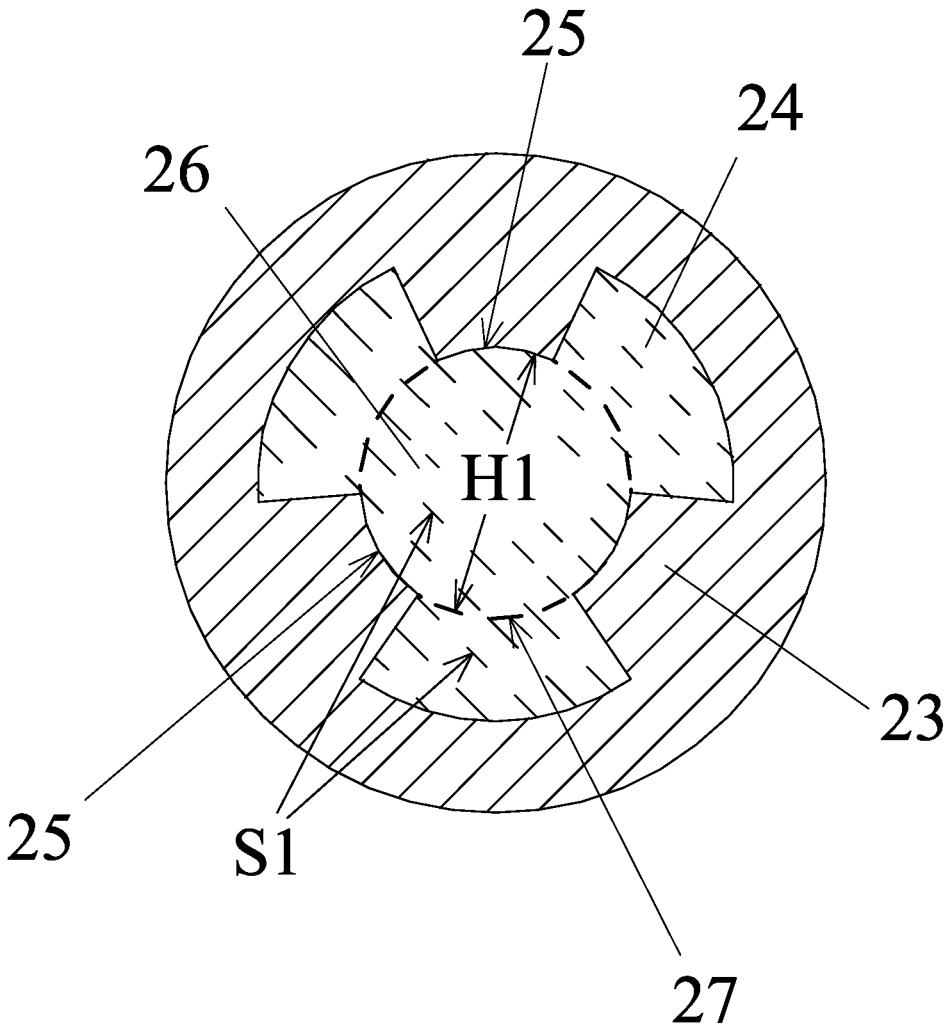
FIG. 5 is another enlarged cross-sectional detail view through section lines 4C-4C of FIG. 4A.

Referring to FIGS. 2 and 5 of the first embodiment of the invention, the ratio $L1/\sqrt{S1}=16.9$, where L1 is the length of the internal channel 17 and S1 is the minimum cross-sectional area which is free for liquid flow.

Figure 6:
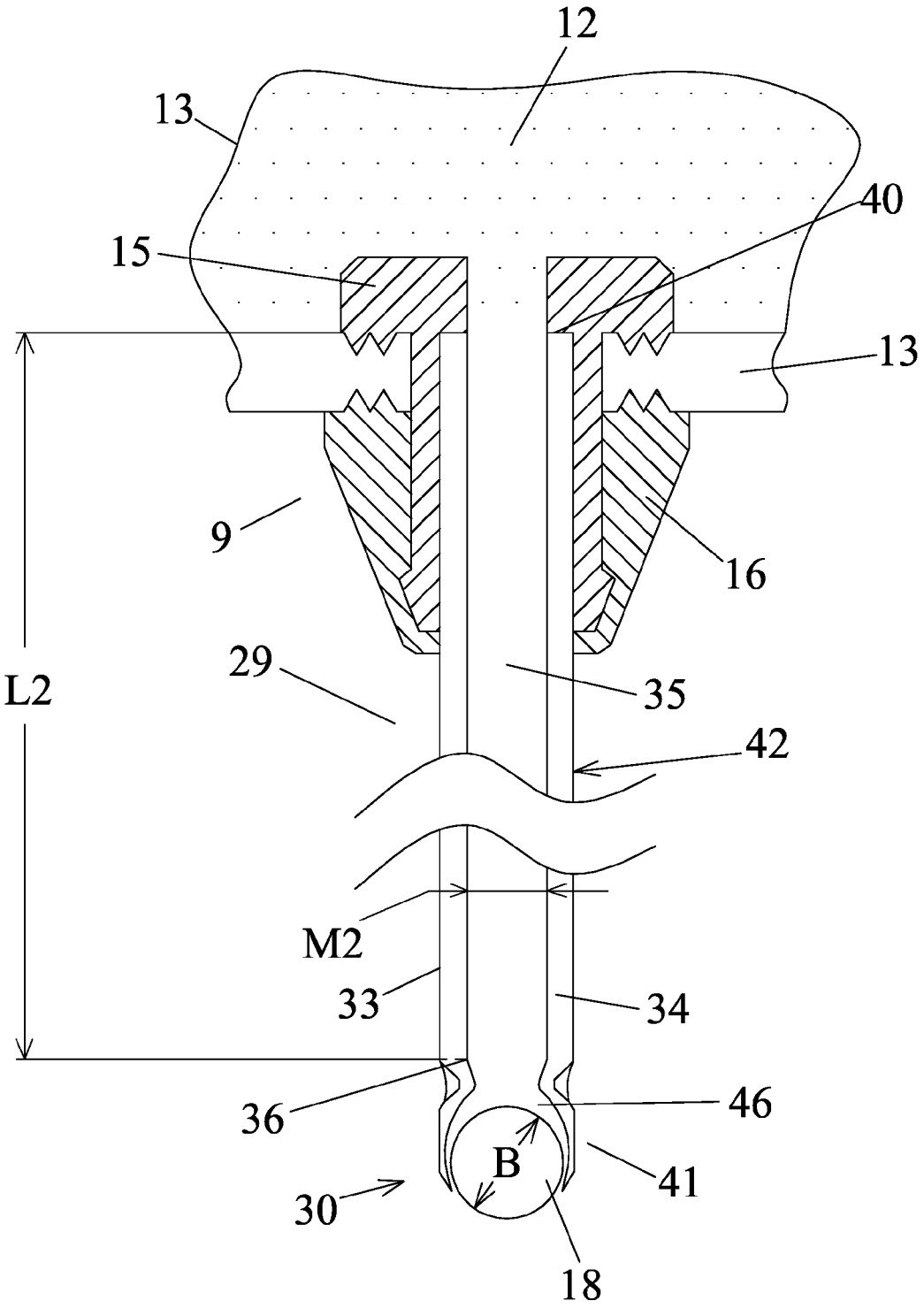
FIG. 6 is a longitudinal cross-section view of a second exemplary embodiment of a liquid-dispensing bristle of the invention mounted to a flexible membrane of a liquid-dispending hairbrush.
Figure 7:
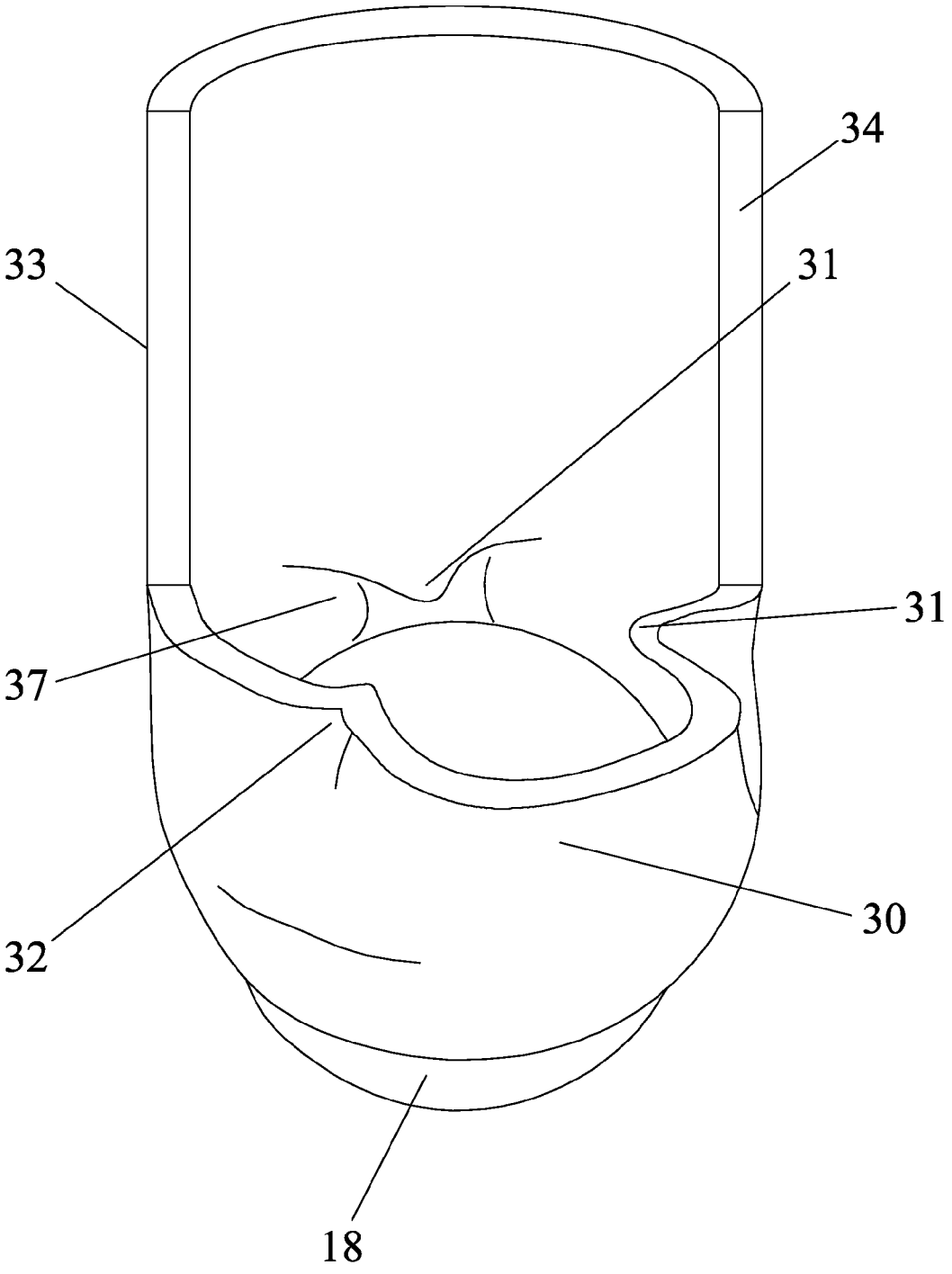
FIG. 7 is an isometric detail view of a distal end of the liquid-dispensing bristle of FIG. 6.
Figure 9:
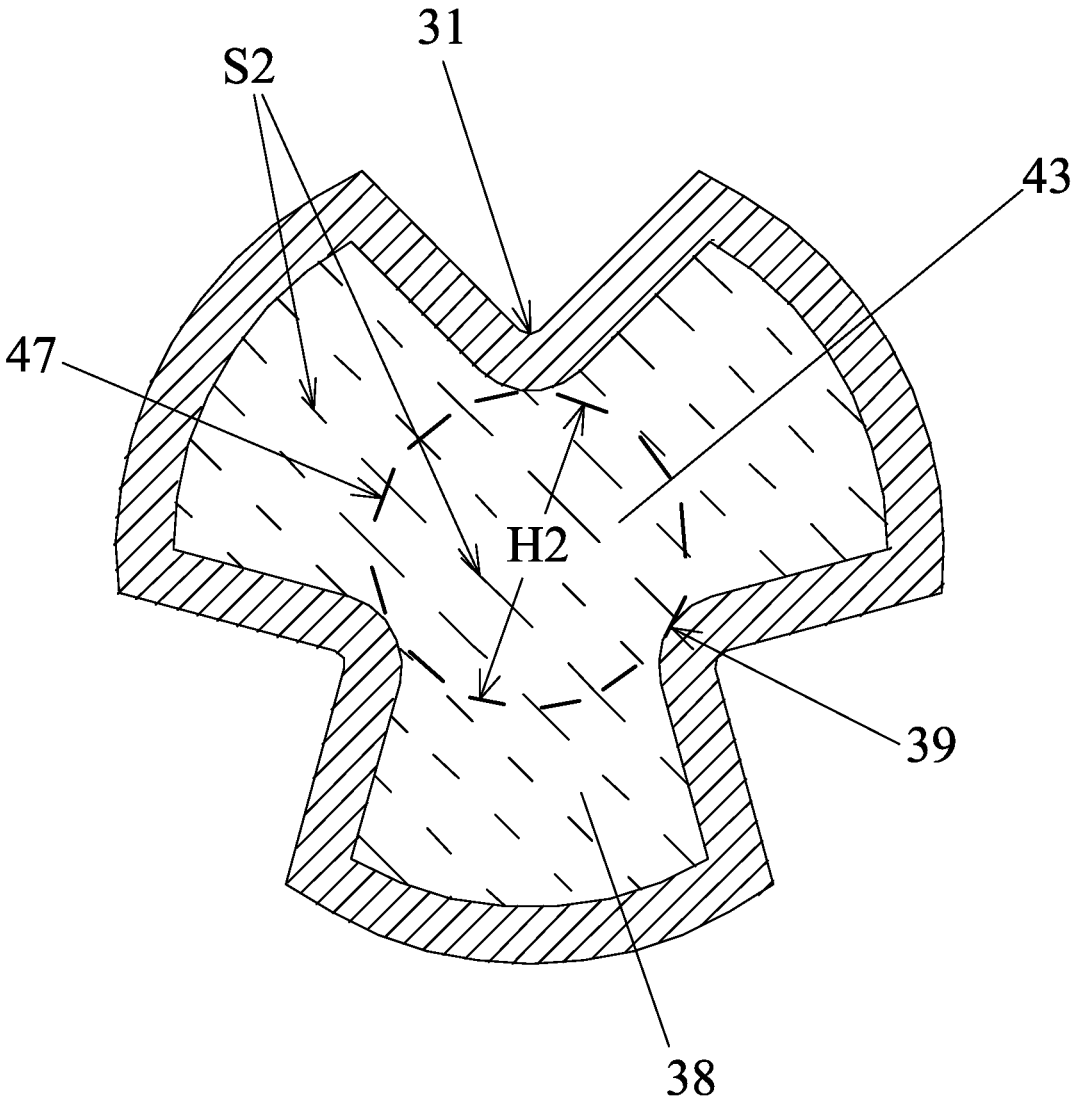
FIG. 9 is another enlarged radial cross-sectional detail view through section lines 8C-8C of FIG. 8A.

Referring to FIGS. 6 and 9 of the second embodiment of the invention, the ratio $L2/\sqrt{S2}=14.5$, where L2 is the length of the internal channel 35 and S2 is the minimum cross-sectional area which is free for liquid flow.

Referring to the first and second embodiments of the invention (FIGS. 2-9), the best combination of the liquid flow in the direction from the liquid reservoir 13 to the ball 18, and the air flow in the direction from the ball 18 to the liquid reservoir 13 is achieved when a ratio of $8<L/\sqrt{S}<25$ is satisfied, where L is the length of the internal channel and S is the minimum cross-sectional area of the ball seat which is free for liquid flow.

Referring to the first and second embodiments of the invention (FIGS. 2-9), the best combination of the liquid flow in the bristle's internal channels in the direction from the liquid reservoir 13 to the ball 18 when the ball 18 contacts the user's scalp during hair-brushing and a minimum natural outflow of the liquid from the roller-ball nozzles of other bristles which do not contact the user's skin at the same time, is achieved when:

the ratio of $L/M>8$ is satisfied, where L is the length of the internal channel and M is the maximum diameter of the internal channel, and the ratio of $M/B<1.3$ is satisfied, where M is the maximum diameter of the internal channel and B is the diameter of the ball.

Referring to the first and second embodiments of the invention (FIGS. 2-9), a minimum natural outflow of the liquid from the roller-ball nozzles of the bristles which positioned downwardly during hair-brushing and do not contact the user's skin at the same time, is achieved when the ratio of $1.33<M/H<3.8$ is satisfied, where M is the maximum diameter of the internal channel and H is the diameter of the central hole.

Referring to the first and second embodiments of the invention (FIGS. 2 and 9), the liquid 12 should preferably have a viscosity less than 0.035 Pa·s, and preferably between about 0.0009 and 0.005 Pa·s at a temperature of about 25 degree Celsius.

The preferred embodiments of this invention have been disclosed, however, so that one of ordinary skill in the art would recognize that certain modifications would come within the scope of this invention.

What is claimed is:

1. A bristle of a liquid-dispensing hairbrush designed to deliver liquids to a user's scalp during hair-brushing only by gravity, and not by capillary action, comprising:

a tube with a tube wall and an outer surface, and with an internal channel, wherein the internal channel has a maximum diameter and a length; and a roller-ball nozzle, wherein the roller-ball nozzle has a ball with a ball diameter, and a ball seat into which the ball movably fits, and wherein the ball seat has plurality of radially spaced apart inwardly directed protrusion portions with protrusion portion spaces therebetween and a ball space, and wherein the protrusion portions have apexes, wherein a central hole is defined by an imaginary circle which contacts the apexes of the protrusion portions, and wherein the central hole has a diameter, and wherein the ball seat has a minimum cross-sectional area which is free for liquid flow;

wherein the protrusion portion spaces and the ball space are large enough so that liquid can flow through the protrusion portion spaces and through the central hole, and through the ball space in the direction from the liquid reservoir to the ball only by gravity, and not by capillary action;

and wherein the protrusion portion spaces and the ball space are large enough so that external air can enter the roller-ball nozzle and travel up through the ball space and through the protrusion portion spaces, and through the central hole, and then through the internal channel of the tube even if the roller-ball does not contact a user's scalp;

and wherein a ratio of $8<L/\sqrt{S}<25$ is satisfied, where L is the length of the internal channel and S is a minimum cross-sectional area of the ball seat which is free for liquid flow;

and wherein the ratio of $L/M>8$ is satisfied, where L is the length of the internal channel and M is the maximum diameter of the internal channel; and wherein the ratio of $M/B<1.3$ is satisfied, where M is the maximum diameter of the internal channel and B is the diameter of the ball.

2. The bristle of the claim 1, wherein the protrusion portions are formed by pressing the outer surface of the tube at in least three points so that the tube wall extends inwardly.

3. The bristle of claim 2, wherein there is a space between the ball and the inwardly directed protrusion portions that is large enough so liquid will flow around the ball and out of the roller-ball nozzle only by gravity and not by capillary action.

4. The bristle of claim 2, wherein the liquid has a viscosity of less than about 0.035 Pa·s at a temperature of about 25 degree Celsius.

5. The bristle of claim 2, wherein the liquid has a viscosity of between about 0.0009 and 0.005 Pa·s at a temperature of about 25 degree Celsius.

6. The bristle of the claim 2, wherein the ratio of $1.33<M/H<3.8$ is satisfied, where M is the maximum diameter of the internal channel and H is the diameter of the central hole.

7. The bristle of the claim 2, wherein the ball is made from stainless steel and the ball diameter ranges in size between 1.2 mm and 2.0 mm.

8. The bristle of claim 1, wherein there is a space between the ball and the inwardly directed protrusion portions that is large enough so liquid will flow around the ball and out of the roller-ball nozzle only by gravity and not by capillary action.

9. The bristle of claim 1, wherein the liquid has a viscosity of less than about 0.035 Pa·s at a temperature of about 25 degree Celsius.

10. The bristle of claim 1, wherein the liquid has a viscosity of between about 0.0009 and 0.005 Pa·s at a temperature of about 25 degree Celsius.

11. The bristle of the claim 1, wherein the ratio of $1.33<M/H<3.8$ is satisfied, where M is the maximum diameter of the internal channel and H is the diameter of the central hole.

12. The bristle of the claim 1, wherein the ball is made from stainless steel and the ball diameter ranges in size between 1.2 mm and 2.0 mm.

13. A liquid-dispensing hairbrush comprising:

a liquid reservoir;

a flexible membrane connected to the liquid reservoir; and a plurality of bristles of claim 1, wherein the balls of at least some of the plurality of bristles are moveable in the ball seats to allow external air to enter the roller-ball nozzles and travel up through the internal channel of the tubes and into the liquid reservoir to equalize air pressure in the liquid reservoir with an external air pressure even if the balls do not contact a user's scalp so that liquid can flow outwardly through the bristles that are in contact with the user's scalp.

14. The liquid-dispensing hairbrush of claim 13, further comprising a flexible membrane connected to the liquid reservoir to which are connected the plurality of bristles.

* * * * *